US005458915A

United States Patent [19]

Yamamoto

[11] Patent Number: 5,458,915

[45] Date of Patent: Oct. 17, 1995

[54] PROCESS FOR PRODUCING HEAT-SENSITIVE STENCIL SHEET

[75] Inventor: Yasuo Yamamoto, Tokyo, Japan

[73] Assignee: Riso Kagaku Corporation, Tokyo, Japan

[21] Appl. No.: 105,404

[22] Filed: Aug. 12, 1993

[30] Foreign Application Priority Data

Aug. 19, 1992 [JP] Japan ..... 4-220335

[51] Int. Cl.[6] ..... B41N 1/24; B05D 1/16; B05D 3/12; B05D 1/04

[52] U.S. Cl. ..... 427/143; 427/206

[58] Field of Search ..... 427/411, 206, 427/143, 375, 144

[56] References Cited

U.S. PATENT DOCUMENTS

| | | | |
|---|---|---|---|
| 3,314,845 | 4/1967 | Perri | 427/206 |
| 3,434,858 | 3/1969 | Dickinson | 427/196 |
| 3,916,823 | 11/1975 | Halloran | 118/63 |
| 3,993,806 | 11/1976 | Athey | 427/206 |
| 4,142,929 | 3/1979 | Otomine et al. | 427/196 |
| 4,209,565 | 6/1980 | Davis et al. | 427/143 |
| 4,246,308 | 1/1981 | Walsh | 427/206 |
| 4,258,094 | 3/1981 | Benedyk | 427/206 |
| 4,362,773 | 12/1982 | Shikinami | 156/220 |
| 4,418,106 | 11/1983 | Landler et al. | 427/206 |
| 4,588,629 | 5/1986 | Taylor | 156/209 |
| 4,657,804 | 4/1987 | Mays | 156/308.2 |
| 5,059,452 | 10/1991 | Squires | 427/206 |
| 5,064,599 | 11/1991 | Ando et al. | 264/237 |
| 5,126,182 | 6/1992 | Lumb et al. | 427/206 |
| 5,164,240 | 11/1992 | Burgess et al. | 427/365 |

FOREIGN PATENT DOCUMENTS

| | | | |
|---|---|---|---|
| 1251775 | 10/1967 | Germany | 427/143 |
| 7010790 | 1/1971 | Netherlands | 427/143 |
| 1404696 | 9/1975 | United Kingdom | 427/143 |

*Primary Examiner*—Diana Dudash

*Attorney, Agent, or Firm*—Fay, Sharpe, Beall, Fagan, Minnich & McKee

[57] ABSTRACT

A process for producing a heat-sensitive stencil sheet (7) is disclosed, which makes it possible to readily form a porous substrate layer having a uniform and dense fiber dispersion on a thermoplastic resin film (3). The process is characterized by electrostatically flocking staple fibers (5) of 0.1–3 denier on a thermoplastic resin film (3) coated with a binder and by thermally compressing them (14) to form a porous substrate layer on the film. Since the porous substrate layer, having a good fiber dispersion, can be formed directly on the film by the electrostatic flocking process, it is possible to make the production process shorter, reduce the production cost and to improve the visual quality of the printed matter.

3 Claims, 2 Drawing Sheets

PROCESS FOR PRODUCING HEAT-SENSITIVE STENCIL SHEET

BACKGROUND OF THE INVENTION

1. Field of the Invention

The present invention relates to a process for producing a heat-sensitive stencil sheet. Specifically, it relates to a novel process for producing a heat-sensitive stencil sheet which makes it possible to readily form a porous substrate layer of fibers with a uniform and dense fiber dispersion on a thermoplastic resin film.

2. Description of the Prior Art

In a prior art, a heat-sensitive stencil sheet is produced by adhering a thermoplastic resin film on a porous substrate such as a porous thin sheet with an adhesive. For example, one surface of an original and a resin film of a heat-sensitive stencil sheet are brought into contact with each other and irradiated by light from the side of the porous substrate of the heat-sensitive stencil sheet in order to generate heat at the black image portion of the original, thereby the heat-sensitive stencil sheet being engraved either by melt-perforating the film of the heat-sensitive stencil sheet with the aid of the generated heat or by reading the original image by an image sensor and then by melt-perforating the film of the heat-sensitive stencil sheet corresponding to the original image by means of a thermal head. The pictorial property of the printed matter obtained by using such a heat-sensitive stencil sheet is, however, influenced not only by the perforating property of the heat-sensitive stencil sheet but also by the fiber dispersibility in the substrate.

Since the heat-sensitive stencil sheet of the prior art used to be prepared by using a porous thin sheet as a substrate through a wet paper making process, then a film were glued to the resulting substrate, the process was complicated and it was difficult to prepare the heat-sensitive stencil sheet by using a single production line from beginning to end.

SUMMARY OF THE INVENTION

It is a main object of this invention to provide a process for producing a heat-sensitive stencil sheet which is a simple process, and makes it possible to readily form a porous substrate layer of fibers on a thermoplastic resin film with a uniform and dense fiber dispersion.

The present invention relates to a process for producing a heat-sensitive stencil sheet, which process comprises electrostatically flocking staple fibers on the surface of a binder-coated thermoplastic resin film so that the one tip end of the fiber is adhered to the film, hardening the binder to obtain a fibers-flocked film and thermally compressing the fibers-flocked film to form a porous substrate layer on the film.

DETAILED DESCRIPTION OF THE PREFERRED EMBODIMENT

The invention will specifically be described with reference to the preferred embodiment in the following.

The staple fiber mentioned above is a mixture of higher melting point fibers and lower melting point fibers or a conjugated fiber of a higher melting point component and a lower melting point component, and the thermal compression is preferred to be carried out at a temperature greater than or equal to the melting point of the lower melting point fiber, but less than the melting point of the higher melting point fiber or component.

As a thermoplastic resin to be used in the invention, polyester, polyvinylidene chloride, polypropylene or vinylidene chloride-vinyl chloride copolymer can be exemplified. The resin film may be commercially available, and the thickness of the film may be in the range of 0.5 μm–5.0 μm.

There is no particular restriction of the binder coated on the film. For example, a water-soluble emulsion binder or ultraviolet hardening-type binder can be applied.

As the staple fibers to be used in the invention, those of polyethylene terephthalate, polypropylene, polyethylene, ethylene-propylene copolymer or polyacrilonitrile can be exemplified. In the case where a higher melting point polymer and a lower melting point polymer are used as components of a conjugate fiber or mixed fibers, a combination of polyethylene terephthalate (polyester) and copolymerized polyester having a lower melting point than that of polyester is preferable. The fineness of the fibers is preferably set to be in the range from 0.1 denier to 3 denier from the standpoint of pictorial property, and the lengths of the fibers are preferably set to be in the range from 0.1 mm to 5 mm. As the fibers become finer, it is harder for them to be electrostatically flocked. Therefore, it is preferable to vary the length of the fiber depending on the fineness of the fiber. For example, the length of the fiber of 3 denier is preferably about 2 mm up to 3 mm. The fiber of 1 denier is preferably about 0.5 mm up to 1 mm.

In the invention, it is preferable that a mixture of a higher melting point fiber and a lower melting point fiber or a conjugate fiber of a higher melting point component and a lower melting point component is used as the staple fiber, and their thermal fusion is carried out at a temperature greater than or equal to the melting point of the lower melting point fiber or component, but less than the melting point of the higher melting point fiber or component.

The use of such a mixture of fibers, or conjugate fibers, makes it easy to carry out thermal compression to form a uniform porous substrate layer after an electrostatic flocking process. It is generally preferable that the fibers to be provided to the electrostatic flocking process are treated by a surfactant and the like so as to have their surface specific resistances in the range of $10^6\Omega$ to $10^9\Omega$.

BRIEF DESCRIPTION OF THE DRAWINGS

The invention will now be described with reference to the accompanying drawings wherein.

Explanation of Reference Characters

1 and 2: electrode plates

3: thermoplastic resin film

4: binder

5: staple fibers

6: porous substrate layer

7: heat-sensitive stencil sheet

10: binder-coated roller group

11: electrostatic flocking apparatus

12: fiber supply apparatus

13: binder-hardening apparatus

14: heat roller

Figure 1:
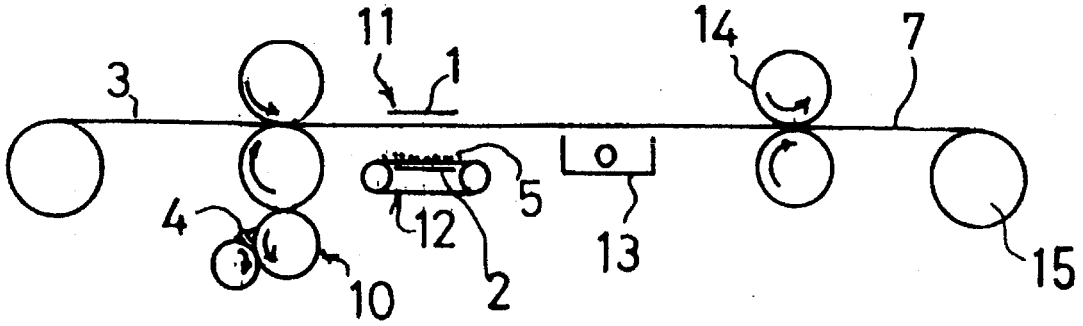
FIG. 1 is an explanatory view showing an example of an apparatus for producing a heat-sensitive stencil sheet according to the present invention.

Referring now to FIG. 1, the detailed description of the method relevant to this invention will specifically be given in the following. The apparatus shown in FIG. 1 mainly comprises a roller group 10 for coating a binder 4 on a thermoplastic resin film 3; an electrostatic flocking apparatus 11 having electrode plates 1 and 2; a fiber supply apparatus 12 for supplying staple fibers 5 consisting of an endless belt conveyer having one of the electrode plates under the belt; a binder-hardening apparatus 13 for hardening a binder 4 coated on the thermoplastic film 3; and a heat roller 14 for thermally compressing the electrostatically flocked staple fibers 5 on the thermoplastic resin film 3 to form a stencil sheet.

Figure 4:
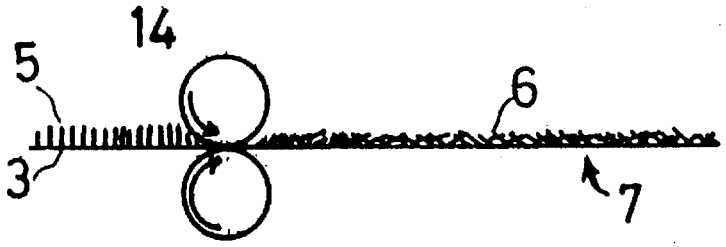
FIG. 4 is a heat-sensitive stencil sheet during thermal compression.

In such a constitution, the thermoplastic resin film 3 is forwarded from a supply roller to the binder-coating roller group 10 to coat the binder 4 thereon, supplied to the electrostatic flocking apparatus 11 and then passed through the electrode plates 1 and 2 subjected to a high voltage. On the other hand, the staple fibers 5 are supplied on the belt of the fiber supply apparatus 12, electrified by the electrode plate 2 under the belt, transferred toward the electrode plate 1, set upright and adhered to the binder surface of the thermoplastic resin film 3, passing through the electrode plates so as to be flocked. The flocked staple fibers are fixed to the thermoplastic resin film 3 by hardening of the binder 4 when the thermoplastic resin film 3 passes through the binder hardening apparatus. In the event that the binder is of an ultraviolet hardening type, an ultraviolet lamp is applied to the binder hardening apparatus. The staple fibers 5 fixed on the film are, further, supplied to the heat roller 14, thermally compressed to form a porous substrate layer 6 as shown in FIG. 4, and then, rolled up on a take-up roller to give a rolled heat-sensitive stencil sheet 15.

Figure 2:
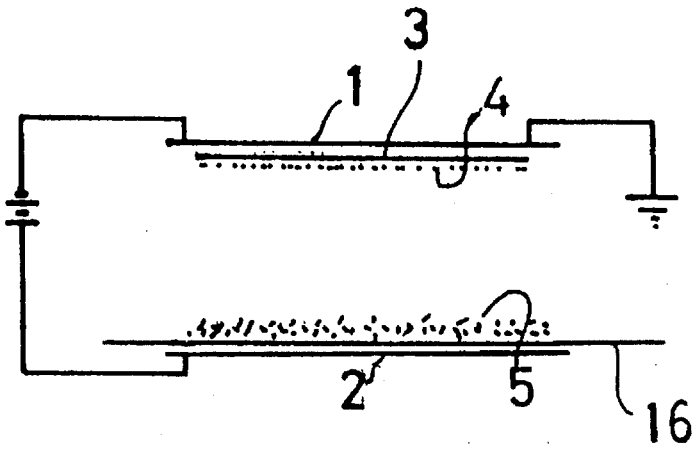
FIG. 2 is an explanatory view showing a principle of an electrostatic flocking in FIG. 1.

FIG. 2 is an explanatory view showing a principle of the electrostatic flocking in FIG. 1. In the drawing, the thermoplastic resin film 3 having a coating of the binder 4 is set on the electrode plate 1, and the staple fibers 5 are set on the belt 16 on the electrode plate 2, so that the binder 4 and the staple fibers 5 may oppose each other. Once a high voltage is applied between the electrode plates 1 and 2, the staple fibers 5 are electrified, transferred along an electric line of force and anchored on the thermoplastic resin film 3 on the opposed electrode plate 1.

Figure 3:
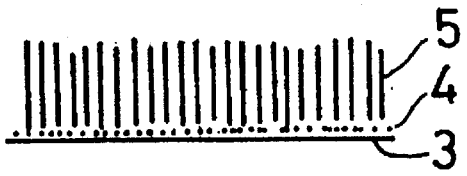
FIG. 3 is a view showing the status of the flocked staple fibers on the thermoplastic resin film.

FIG. 3 shows the status of the staple fibers 5 anchored on the thermoplastic resin film 3. The staple fibers 5 are adhered to the film 3 by means of the binder 4 at its one tip end portion and stand upright on the film 3 so as to be flocked.

The distance between the electrode plates, applied voltage, flocking time, etc., are properly chosen depending on the kind of fibers used, surface specific resistance and so forth.

The flocked quantity of the staple fibers depends on the fiber materials, and it preferably ranges from 5 g/cm$^2$ to 15 g/m$^2$ in the case of using polyethylene terephthalate. The flocked quantity can be constant by strictly controlling the applied voltage and time, the distance between the electrode plates, and so forth.

FIG. 4 shows a heat-sensitive stencil sheet which has been obtained by passing the film 3 of the electrostatically flocked staple fibers 5 through the heat rollers 14 so as to be thermally compressed thereby. Since the staple fibers flocked on the film are passed through the heat rollers in order to be thermally compressed so that the lower melting point fibers or components are melted to serve as an adhesive, the fibers bind with one another resulting in the formation of a porous substrate layer 6 which has a high dispersion of fibers.

EXAMPLE 1

A heat-sensitive stencil sheet was prepared by means of an apparatus shown in FIG. 1. A mixture of polyester fibers with copolymerized polyester fibers as the staple fibers 5 in FIG. 1 was prepared by blending the both fibers at the weight ratio of 2:1 (the former:the latter) using a carding machine. The polyester fiber (m.p. 260° C. and surface specific resistance $10^8\Omega$) has a fineness 3 denier and a length of 1 mm and the copolymerized polyester fiber (m.p. 110°–140° C. and surface specific resistance $10^8\Omega$) has a fineness of 1.5 denier and a length of 1 mm. As a thermoplastic resin film 3, a polyester film having 2 μm in thickness was used. As a binder 4, a water-soluble emulsion binder was used. Flocking of the fibers 5 on the film 3 was carried out under the condition that the distance between electrode plates was 5 cm, applied voltage was 6000 VDC and flocking time was 5 sec. The flocked staple fibers were thermally compressed by the heat roller at 150° C. (under a bearing pressure of 25 kgf/cm$^2$) to form a porous substrate layer. When the surface of the porous substrate layer was subjected to electromicroscopic observation, it was confirmed that the fibers were adhered at the contact points thereof and were excellent in fibers dispersion.

What is claimed is:

1. A process for producing a heat-sensitive stencil sheet, which process comprises:

electrostatically flocking staple fibers, having a fineness in a range of 0.1–3 denier and a length in a range of 0.1–5 mm, on a surface of a binder-coated thermoplastic resin film, the resin film having a thickness in the range of 0.5–5.0 μm so that one tip end of the staple fibers is adhered to the film, and melt-adhering said staple fibers with each other by thermal compression to form a porous substrate layer on the film.

2. A process for producing a heat-sensitive stencil sheet according to claim 1, wherein the electrostatically flocked staple fibers are a mixture of higher melting point fibers and lower melting point fibers or a conjugated fiber of a higher melting point component and a lower melting point component, and said thermal compression is carried out at a temperature greater than or equal to the melting point of said lower melting point fiber, but less than the melting point of said higher melting point fiber or component.

3. A process for producing a heat-sensitive stencil sheet according to claim 1, wherein the porous substrate layer on the film formed by thermal compression is uniform.

* * * * *